US010894202B1

(12) United States Patent
Tseng

(10) Patent No.: US 10,894,202 B1
(45) Date of Patent: Jan. 19, 2021

(54) SHUFFLING MACHINE HAVING AUXILIARY CARD PRESS STRUCTURE

(71) Applicant: Bingotimes Digital Technology Co., Ltd., Taichung (TW)

(72) Inventor: Kuo-Lung Tseng, Taichung (TW)

(73) Assignee: BINGOTIMES DIGITAL TECHNOLOGY CO., LTD., Taichung (TW)

( * ) Notice: Subject to any disclaimer, the term of this patent is extended or adjusted under 35 U.S.C. 154(b) by 0 days.

(21) Appl. No.: 16/572,602

(22) Filed: Sep. 17, 2019

(51) Int. Cl.
*A63F 1/12* (2006.01)
*A63F 1/08* (2006.01)
*A63F 11/00* (2006.01)

(52) U.S. Cl.
CPC ..... *A63F 1/12* (2013.01); *A63F 1/08* (2013.01); *A63F 11/0002* (2013.01)

(58) Field of Classification Search
CPC ..... A63F 1/12; A63F 11/0002; A63F 1/08
USPC ..... 273/149 R, 149 P; 463/22
See application file for complete search history.

(56) References Cited

U.S. PATENT DOCUMENTS

2010/0283202 A1* 11/2010 Ho ..... A63F 1/12 273/149 R
2012/0056373 A1* 3/2012 Jones ..... A63F 1/00 273/149 R
2015/0290528 A1* 10/2015 Sampson ..... A63F 1/14 273/149 R

* cited by examiner

*Primary Examiner* — Benjamin Layno
(74) *Attorney, Agent, or Firm* — Raymond Y. Chan; David and Raymond Patent Firm

(57) ABSTRACT

A shuffling machine having an auxiliary card press structure is disclosed. The shuffling machine includes at least one card delivering roller assembly. An outer side of the card delivering roller assembly is pivotally connected with a press arm having a return spring. Another end of the press arm is provided with a card press roller assembly. The card press roller assembly includes at least one magnetic roller. The card delivering roller assembly is provided with at least one magnetic member corresponding to the magnetic roller. When a left accommodating compartment or a right accommodating compartment of the shuffling machine has few playing cards, the magnetic member can attract the magnetic roller to increase the force of the card press roller assembly against the playing cards to increase friction to ensure smooth delivery without idling.

4 Claims, 3 Drawing Sheets

SHUFFLING MACHINE HAVING AUXILIARY CARD PRESS STRUCTURE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a shuffling machine, and more particularly to a shuffling machine having an auxiliary card press structure that has a magnetic member to attract a press arm to increase friction and ensure smooth delivery, without idling.

Description of Related Arts

As shown in FIG. 1, a conventional shuffling machine 10 has a central accommodating compartment 11, a left accommodating compartment 12, and a right accommodating compartment 13. Each of the left accommodating compartment 12 and the right accommodating compartment 13 is provided with a card delivering roller assembly 16. The central accommodating compartment 11 is provided with a central lifting platform 17 that can ascend and descend. A lifting platform 18 is disposed in each of the left accommodating compartment 12 and the right accommodating compartment 13. The outer side of each of the left accommodating compartment 12 and the right accommodating compartment 13 is pivotally connected with a press arm 22 having a return spring 221. Another end of the press arm 22 is provided with a card press roller 222. When the lifting platform 18 in the left accommodating compartment 12 or the right accommodating compartment 13 carries the playing cards 1 and descends, each press arm 22 is pivotally pressed against the playing cards 1. The elastic force of the return spring 221 enables the card press roller 222 to press against the playing cards 1, so that each card delivering roller assembly 16 can rotate and deliver the playing cards 1 smoothly to the central lifting platform 17 by friction to avoid idling, thereby imitating a manual shuffle to achieve an automatic shuffle. However, in the above-mentioned shuffling machine 10, although the playing cards 1 can be automatically shuffled, it still has the following disadvantage.

When the shuffling machine 10 performs a shuffling operation, the playing cards 1 are delivered to the central accommodating compartment 11 from the left accommodating compartment 12 and the right accommodating compartment 13 by the card delivering roller assembly 16. By the elastic force of the return spring 221, the card press roller 222 of the press arm 22 is pressed against the playing cards 1 to increase friction between the playing cards 1 and the card delivering roller assembly 16, so that the rotatable card delivering roller assembly 16 delivers the playing cards 1 into the central accommodating compartment 11 exactly. The playing cards 1 placed in the left accommodating compartment 12 and the right accommodating compartment 13 are gradually reduced because they are delivered to the central accommodating compartment 11, so the total thickness of the remaining playing cards 1 is reduced. The card press roller 222 biased by the return spring 221 fails to have the same downward force to press against the playing cards 1, that is, the elastic force of the return spring 221 is weakened and the friction between the playing cards 1 and the card delivering roller assembly 16 is recued. Even the return spring 221 has lost the elastic force against the playing cards 1, causing the card delivering roller assembly 16 to be idling without actually driving the playing cards 1.

When the above situation occurs, the obstacle needs to be removed manually. The shuffling machine 10 has a high failure rate, which affects the fairness and reduces the player's game interest. Accordingly, the inventor of the present invention has devoted himself based on his many years of practical experiences to solve these problems.

SUMMARY OF THE PRESENT INVENTION

The primary object of the present invention is to solve the aforesaid problems and to provide a shuffling machine having an auxiliary card press structure. Either side of the shuffling machine is pivotally connected with a press arm having a return spring. Another end of the press arm is provided with a card press roller assembly having a magnetic roller.

Each of a left accommodating compartment and a right accommodating compartment of the shuffling machine is provided with a magnetic member for attracting the magnetic roller. Thereby, the magnetic member can attract the magnetic roller to increase the press force against a small number of playing cards, increasing friction to ensure smooth delivery without idling.

In order to achieve the above object, a shuffling machine having an auxiliary card press structure is provided. The shuffling machine comprises at least one card delivering roller assembly. An outer side of the card delivering roller assembly is pivotally connected with a press arm having a return spring. Another end of the press arm is provided with a card press roller assembly. The card press roller assembly includes at least one magnetic roller. The card delivering roller assembly is provided with at least one magnetic member corresponding to the magnetic roller.

In an embodiment of the present invention, the magnetic roller is made of a magnetic material selected from one of iron, nickel and cobalt, and the magnetic member is a magnet.

Thereby, when the left accommodating compartment or the right accommodating compartment has few playing cards, the magnetic member can attract the magnetic roller to increase the force of the card press roller assembly against the playing cards to increase friction to ensure smooth delivery without idling.

DETAILED DESCRIPTION OF THE PREFERRED EMBODIMENT

Embodiments of the present invention will now be described, by way of example only, with reference to the accompanying drawings.

Figure 1:
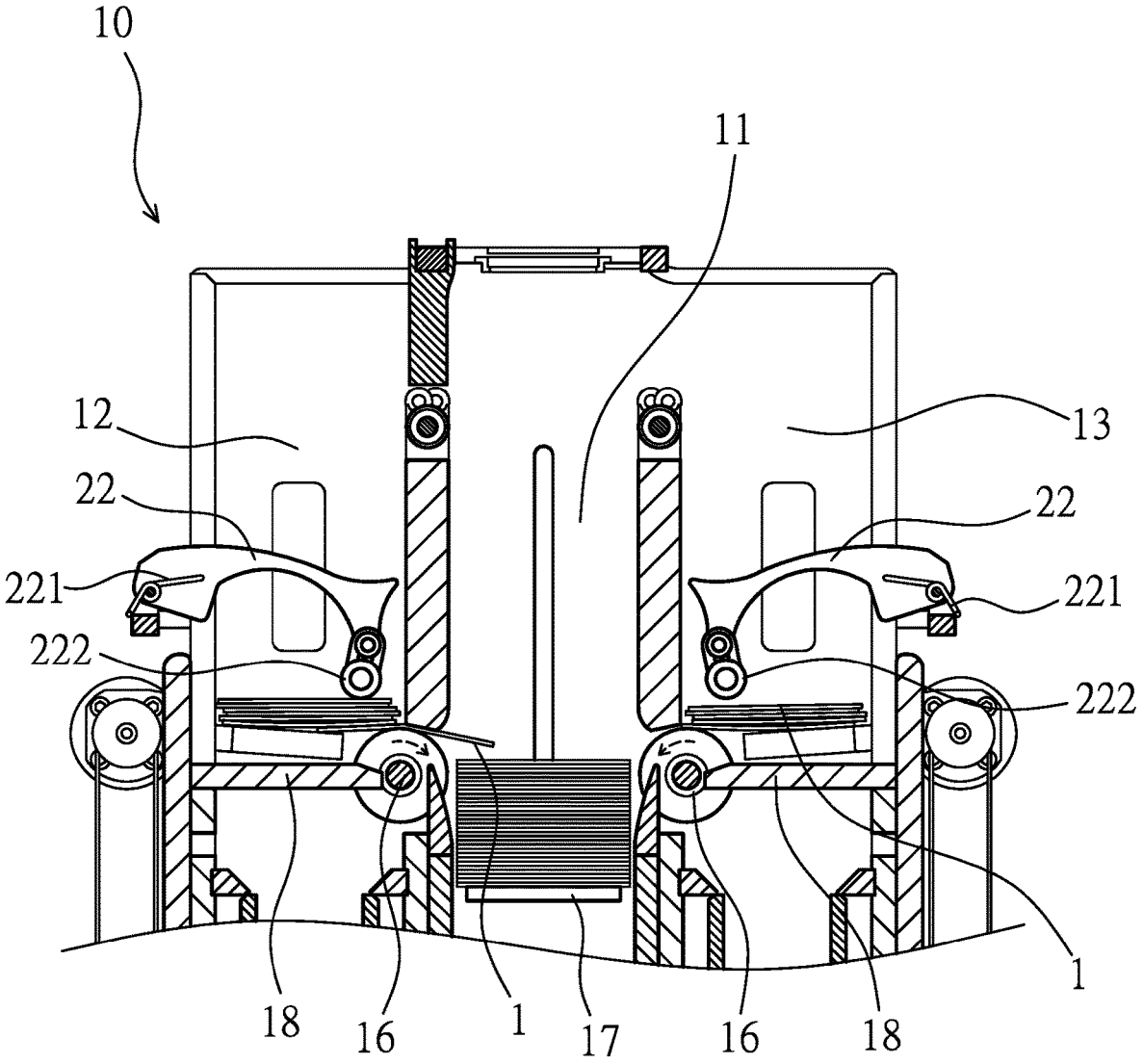
PRIOR ART FIG.1
FIG. 1 is a front cross-sectional view of a conventional shuffling machine, showing that a press arm loses its elastic force and fails to press against playing cards.
Figure 2:
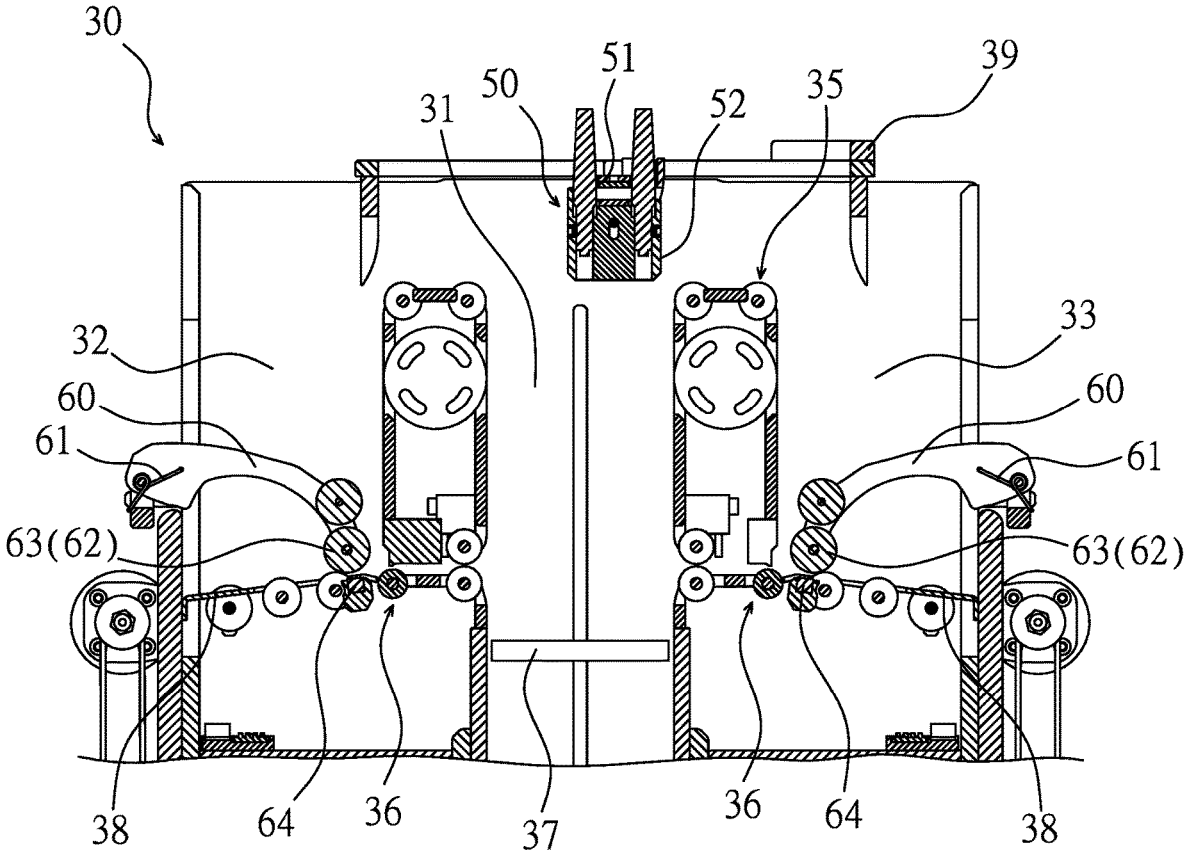
FIG. 2 is a front sectional view of the present invention.
Figure 3:
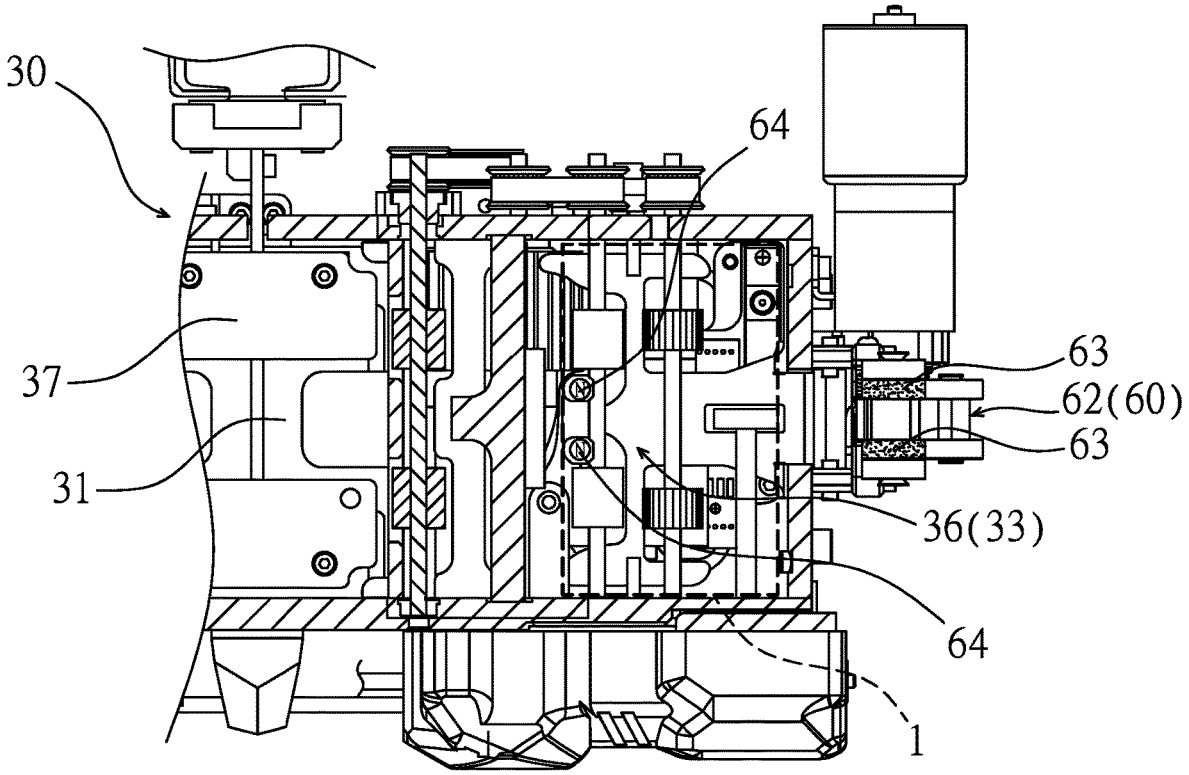
FIG. 3 is a top sectional view of the present invention.

Referring to FIG. 2 and FIG. 3, the present invention discloses a shuffling machine 30 having an auxiliary card press structure. The shuffling machine 30 has a central accommodating compartment 31, a left accommodating compartment 32, and a right accommodating compartment 33. Each of the left accommodating compartment 32 and the right accommodating compartment 33 is provided with a card delivering roller assembly 36. The central accommodating compartment 31 is provided with a central lifting platform 37. A lifting platform 38 is disposed in each of the left accommodating compartment 32 and the right accommodating compartment 33. The outer side of each of the left accommodating compartment 32 and the right accommodating compartment 33 is pivotally connected with a press arm 60 having a return spring 61. Another end of the press arm 60 is provided with a card press roller assembly 62. The card press roller assembly 62 includes at least one magnetic roller 63. The card delivering roller assembly 36 is provided with at least one magnetic member 64 corresponding to the magnetic roller 63. When the left accommodating compartment 32 or the right accommodating compartment 33 has few playing cards 1, the magnetic member 64 can attract the magnetic roller 63 to increase the force of the card press roller assembly 62 against the playing cards 1 to increase friction to ensure smooth delivery without idling.

The assembly, function and details of the present invention are described below. Referring to FIG. 2 and FIG. 3, the magnetic roller 63 of the card press roller assembly 62 is made of a magnetic material, such as iron, nickel, cobalt or the like. The magnetic member 64 of the card delivering roller assembly 36 may be a magnet configured to attract the magnetic roller 63 within the magnetic field of the magnetic member 64. The magnetic member 64 of the card delivering roller assembly 36 is disposed lower than the top edge of the card delivering roller assembly 36. When the number of the playing cards 1 is small, the magnetic member 64 can magnetically interact with the magnetic roller 63. At this time, the return spring 61 is in a state in which the elastic force is weak or even inelastic, and the magnetic force of the magnetic member 64 is supplied to the press arm 60 to assist in pressing the playing cards 1, thereby solving the problem that the return spring 61 cannot reliably press the playing cards 1 when the number of the playing cards 1 is small. When the playing cards 1 has been dispensed to the left accommodating compartment 32 and the right accommodating compartment 33 for shuffling, each of the lifting platforms 38 is lowered, such that the bottom of the playing cards 1 respectively located in the left accommodating compartment 32 and the right accommodating compartment 33 is in contact with the card delivering roller assembly 36. Next, each press arm 60 can be pivoted in an outside-in manner by the lowering of the lifting platform 38, and the card press roller assembly 62 press against the playing cards 1, so that the playing cards 1 have appropriate pressure to press against the card delivering roller assembly 36, i.e., to generate appropriate friction between the playing cards 1 and the card delivering roller assembly 36. In this way, each card delivering roller assembly 36 is rotated toward the center of the shuffling machine 30, and the bottommost playing cards 1 of the left accommodating compartment 32 and the right accommodating compartment 33 are respectively delivered to the central lifting platform 37 of the central accommodating compartment 31 by the frictional force for shuffling. When the left accommodating compartment 32 and the right accommodating compartment 33 have few playing cards 1, the press force of the press arm 60 biased by the return spring 61 is less than the press force when there are many playing cards 1. Sometimes, after the shuffling machine 30 is used for a long time, the return spring 61 may be elastically fatigued, that is, although the left accommodating compartment 32 and the right accommodating compartment 33 have the playing cards 1, the return spring 61 has lost the elastic force to press against the playing cards 1. Since the card press roller assembly 62 of the press arm 60 gradually approaches the magnetic member 64 as the number of the playing cards 1 decreases, the magnetic force of the magnetic member 64 differently generates different ranges of magnetic fields, so the magnetic member 64 with a suitable magnetic force can be selected for application. When the card press roller assembly 62 enters the magnetic field of the magnetic member 64 as the number of the playing cards 1 decreases, the magnetic member 64 attracts the magnetic roller 63 to increase the force of the card press roller assembly 62 against the playing cards 1. The less the number of playing cards 1 is, the weaker the elastic force of the return spring 61 is. On the contrary, the stronger magnetic force of the magnetic member 64 on the magnetic roller 63 can assist the press arm 60 in maintaining a proper press force against few playing cards 1, so that the playing cards 1 can be reliably delivered to the central lifting platform 37 of the central accommodating compartment 31 by the card delivering roller assembly 36, thereby increasing friction to ensure smooth delivery without idling.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A shuffling machine, comprising:

a central accommodating compartment;

a left accommodating compartment;

a right accommodating compartment;

two card delivering roller assemblies which are respectively provided in said left accommodating compartment and said right accommodating compartment and rotated toward a center of the shuffling machine, wherein each of said card delivering roller assemblies comprises a lifting platform, a press arm and a magnetic member on said lifting platform, wherein a magnetic force of said magnetic member is provided to said press arm, wherein said two lifting platforms are respectively disposed in said left accommodating compartment and said right accommodating compartment, wherein said press arm further comprises a return spring which is provided on one end of said press arm and pivotally connected with each of said left accommodating compartment and said right accommodating compartment; and a card press roller assembly, provided on another end of said press arm, comprising at least one magnetic roller corresponding to said magnetic member for delivering play cards pressed on said two lifting platforms by said press arm to said central accommodating compartment.

2. The shuffling machine, as recited in claim 1, wherein said magnetic roller of said card press roller assembly is made of a magnetic material selected from a group consisting of iron, nickel and cobalt.

3. The shuffling machine, as recited in claim 1, wherein said magnetic member is a magnet configured to attract said magnetic roller of said card press roller assembly of said press arm.

4. The shuffling machine, as recited in claim 1, wherein said central lifting platform comprises a central accommodating compartment configured in such a manner that bottommost playing cards on said two lifting platforms of said left accommodating compartment and said right accommodating compartment are respectively delivered to said central accommodating compartment of said central lifting platform by said two card delivering roller assemblies.

* * * * *